US006078307A

United States Patent [19]

Daly

[11] Patent Number: 6,078,307

[45] Date of Patent: Jun. 20, 2000

[54] METHOD FOR INCREASING LUMINANCE RESOLUTION OF COLOR PANEL DISPLAY SYSTEMS

[75] Inventor: Scott J. Daly, Kalama, Wash.

[73] Assignee: Sharp Laboratories of America, Inc., Camas, Wash.

[21] Appl. No.: 09/041,812

[22] Filed: Mar. 12, 1998

[51] Int. Cl.[7] ..... G09G 5/00

[52] U.S. Cl. ..... 345/132; 345/153

[58] Field of Search ..... 345/132, 150, 345/151, 153, 152, 154, 155, 3, 127–130; 348/390, 391, 393, 396

[56] References Cited

U.S. PATENT DOCUMENTS

| | | | |
|---|---|---|---|
| 4,484,188 | 11/1984 | Ott . | |
| 4,580,160 | 4/1986 | Ochie et al. . | |
| 4,633,294 | 12/1986 | Nadan . | |
| 4,725,881 | 2/1988 | Buchwald . | |
| 4,870,268 | 9/1989 | Vincent et al. . | |
| 5,124,786 | 6/1992 | Nikoh . | |
| 5,398,066 | 3/1995 | Martinez-Uriegas et al. . | |
| 5,528,740 | 6/1996 | Hill et al. . | |
| 5,541,653 | 7/1996 | Peters et al. . | |
| 5,543,819 | 8/1996 | Farwell et al. . | |
| 5,874,937 | 2/1999 | Kesatoshi | 345/132 |

OTHER PUBLICATIONS

Mullen, Kathy T., *The Contrast Sensitivity of Human Colour Vision to Red–Green and Blue–Yellow Chromatic Gratings,* J. Physiol (1985) pp. 381–400.

Tyler et al., *Bit–Stealing: How to Get 1786 or More Grey Levels from an 8–bit Color Monitor,* SPIE vol. 1666 Human Vision, Visual Processing, and Digital Display III (1992) pp. 351–364.

Daly, Scott, *The Visible Differences Predictor: An Algorithm for the Assessment of Image Fidelity,* Digital Images and Human Vision, A.B. Watson, Ed., MIT Press (1993) Ch 14.

*Primary Examiner*—Regina Liang
*Attorney, Agent, or Firm*—Robert D. Varitz, PC

[57] ABSTRACT

A method for increasing luminance resolution of color panel systems includes inputting an image, $I_0$, having a first resolution, wherein image $I_0$ includes color difference images, $C1_0$, $C2_0$ and a luminance image, $L_0$; manipulating images $C1_0$, $C2_0$ and $L_0$ in a first course, including: filtering and subsampling the images to form images, $C1_1$, $C2_1$, and $L_1$, having a second resolution, H×V; converting images $C1_1$, $C2_1$ and $L_1$, to a first RGB domain image, $RGB_1$; spatially multiplexing $RGB_1$ into an image $I_A$, having a third resolution, 2H×2V; and manipulating image $L_1$ in a second course, including: upsampling $L_1$ to form $L_2$, having the third resolution; forming a difference image, $I_D$ between $L_2$ and $L_0$; converting image $I_D$ into a second RGB domain image, $RGB_2$,using predetermined values for C1 and C2; subsampling $RGB_2$, spatially and chromatically, into an image $I_B$ having the third resolution; combining $I_A$ and $I_B$, in a pixel-dependant manner, into an image $I_F$; and dividing $I_F$ into RGB components at the second resolution.

16 Claims, 6 Drawing Sheets

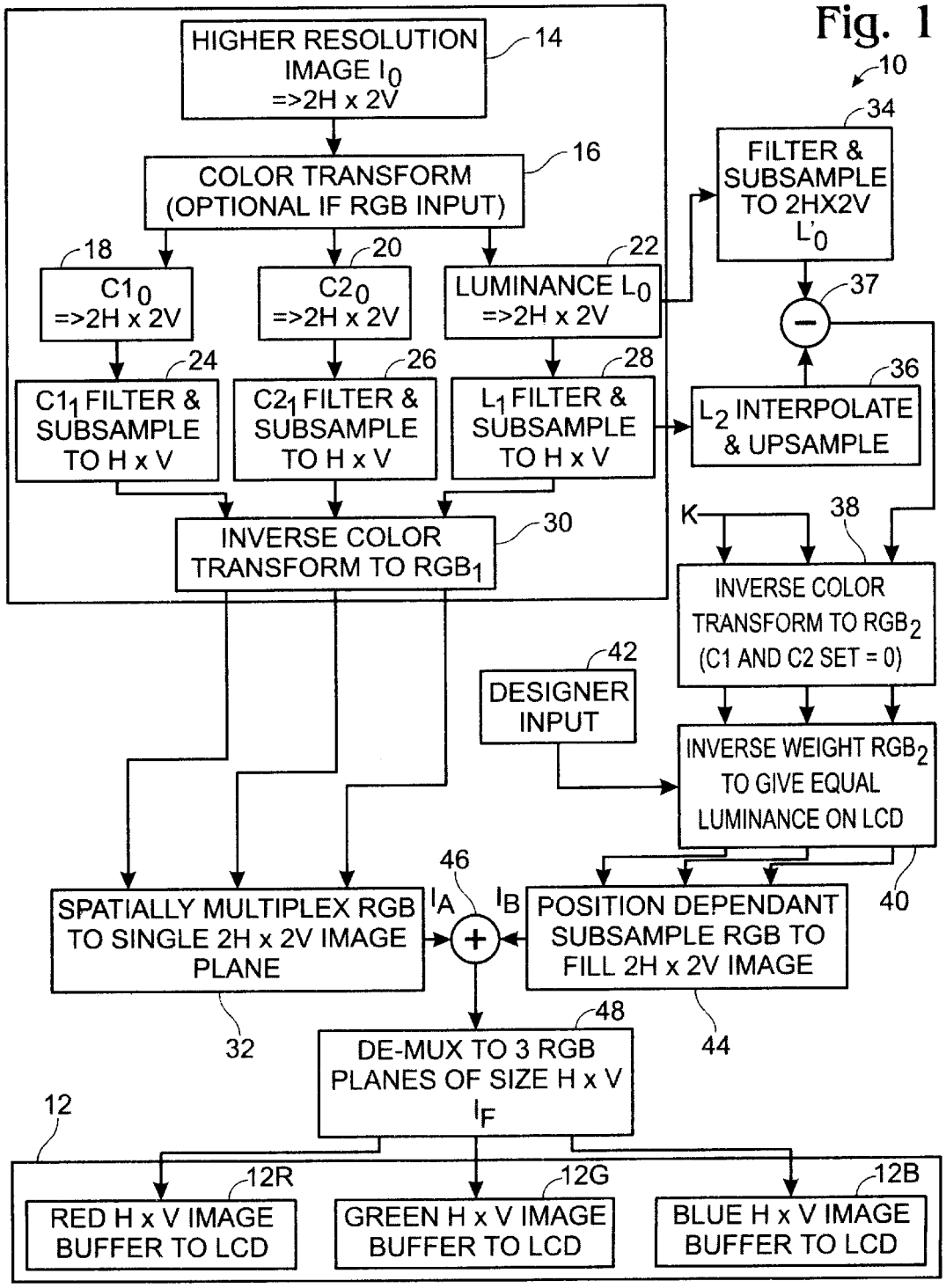
Fig. 1
10
HIGHER RESOLUTION IMAGE $I_0$ =>2H x 2V
14
COLOR TRANSFORM (OPTIONAL IF RGB INPUT)
16
18
$C1_0$ =>2H x 2V
20
$C2_0$ =>2H x 2V
22
LUMINANCE $L_0$ =>2H x 2V
24
$C1_1$ FILTER & SUBSAMPLE TO H x V
26
$C2_1$ FILTER & SUBSAMPLE TO H x V
28
$L_1$ FILTER & SUBSAMPLE TO H x V
30
INVERSE COLOR TRANSFORM TO $RGB_1$
34
FILTER & SUBSAMPLE TO 2HX2V $L'_0$
37
36
$L_2$ INTERPOLATE & UPSAMPLE
K
38
INVERSE COLOR TRANSFORM TO $RGB_2$ (C1 AND C2 SET = 0)
42
DESIGNER INPUT
INVERSE WEIGHT $RGB_2$ TO GIVE EQUAL LUMINANCE ON LCD
40
46
$I_A$
$I_B$
SPATIALLY MULTIPLEX RGB TO SINGLE 2H x 2V IMAGE PLANE
POSITION DEPENDANT SUBSAMPLE RGB TO FILL 2H x 2V IMAGE
32
44
48
DE-MUX TO 3 RGB PLANES OF SIZE H x V $I_F$
12
12R
RED H x V IMAGE BUFFER TO LCD
12G
GREEN H x V IMAGE BUFFER TO LCD
12B
BLUE H x V IMAGE BUFFER TO LCD

| | | | | |
|---|---|---|---|---|
| G | R | G | R | G |
| B | | B | | B |
| G | R | G | R | G |
| B | | B | | B |
| | | | | |

METHOD FOR INCREASING LUMINANCE RESOLUTION OF COLOR PANEL DISPLAY SYSTEMS

FIELD OF THE INVENTION

This invention relates to color panel displays, and specifically to a method for enhancing the display of color digital images.

BACKGROUND OF THE INVENTION

This invention applies to video or graphics projection systems that use color panels having a resolution of H×V pixels, where source images or sequences are available at higher resolutions, e. g., 2H×2V, or greater. The commonly known methods for displaying images with higher resolution than the individual display panels resolution include the following:

1) Direct subsampling without filtering of the high resolution image to the lower panel resolution;

2) Filtering or other local spatial averaging prior to subsampling down to the resolution in order to prevent aliasing;

3) Subsampling, with or without filtering, down to the resolution and applying spatial image enhancement techniques such as unsharp masking or high-pass filtering to improve the perceived appearance of the displayed image.

In all three of the known techniques, there is a loss of spatial information from the high resolution image. Technique 1 tends to preserve sharpness but also causes aliasing to occur in the image. Technique 2 tends to prevent aliasing but results in a more blurred image. Technique 3 can result in an image that has little or no aliasing and can appear sharper by using high-pass filtering which steepens the slope of edges. However, technique 3 has limitations in that overshoots result on the edges, causing "haloing" artifacts in the image. Also, because technique 3 has no further true image information than techniques 1 or 2, there is a general loss of low-amplitude, high-frequency information, which is necessary for true rendition of textures. The effect on textures is that they are smoothed. Important low-amplitude texture regions include hair, skin, waterfalls, lawns, etc.

U.S. Pat. No. 4,484,188, "Graphics Video Resolution Improvement Apparatus," to Ott, discloses a method of forming additional video lines between existing lines and combining the data from the existing lines by interpolation. It is primarily intended for graphics character applications and the prevention of rastering artifacts, also know as "edge jaggies".

U.S. Pat. No. 4,580,160, "Color Image Sensor with Improved Resolution Having Time Delays in a Plurality of Output Lines," to Ochi, uses a 2D hexagonal element sensor array which is loaded into a horizontal shift register. Delays are used to load alternating columns into the register, thus providing an increase in resolution for a given register size.

U.S. Pat. No. 4,633,294, "Method for Reducing the Scan Line Visibility for Projection Television by Using Different Interpolation and Vertical Displacement for Each Color Signal," to Nadan, discloses a technique that spatially shifts, in the vertical, the red, green and blue (RGB) scan lines with respect each other in order to reduce the visibility of the scan lines. Interpolation of the data for the offset scan lines color plane is used to reduce edge color artifacts.

U.S. Pat. No. 4,725,881, "Method for Increasing the Resolution of a Color Television Camera with Three Mutually Shifted Solid-State Image Sensors," to Buchwald, uses spatially shifted sensors to capture the RGB image signals. The shift allows a higher resolution color signal to be formed, which is then transformed into Y, R-Y, and B-Y signals. The luminance signal is low-pass-filtered (LPF), high-pass-filtered (HPF), and the two filtered signals added together. The color signals are low-pass filtered, and further modulated by a control signal which is formed from the high-pass filtered luminance signal. The luminance signal acts as a control for modulating the amplitude of the color signals.

U.S. Pat. No. 5,124,786, "Color Signal Enhancing Circuit for Improving the Resolution of Picture Signals," to Nikoh, splits the chrominance image signals into LPF and HPF halves. The HPF half is amplified and added back to the LPF. The purpose is to boost high frequency color without affecting the luminance signal.

U.S. Pat. No. 5,398,066, "Method and Apparatus for Compression and Decompression of Digital Color Images," to Martinez-Uriegas et al., uses color multiplexing of RGB pixels to compress a single layer image. The M-plane, which is defined as a method of spatially combining different spectral samples, is described and is referred to as "color multiplexing." Methods for demultiplexing the image back to three full-resolution image planes, and the CFA interpolation problem, are discussed, as are various correction technique for the algorithms artifacts, such as speckle correction for removing 2-D high frequency chromatic regions.

U.S. Pat. No. 5,528,740, "Conversion of Higher Resolution Images for Display on a Lower-Resolution Display Device," to Hill et al., is a system for converting a high-resolution bitonal bit-map for display on a lower-resolution pixel representation display. It introduces the concept of "twixels" which are multibit pixels that carry information from a number of high-resolution bitonal pixels. This information may trigger rendering decisions at the display device to improve the appearance of text characters. It primarily relates to the field of document processing.

U.S. Pat. No. 5,541,653, "Method and Apparatus for Increasing Resolution of Digital Color Images Using Correlated Decoding," to Peters, describes a technique for improving luminance resolution of captured images from 3 CCD cameras, by spatially offsetting the RGB sensors by ½ pixels.

U.S. Pat. No. 5,543,819, "High Resolution Display System and Method of Using Same," to Farwell et al., uses a form of dithering to display high-resolution color signals, where resolution refers to amplitude resolution, i.e., bit-depth, on a projection system using single-bit LCD drivers.

Tyler, et al., *Bit Stealing: How to get* 1786 *or More Grey Levels from an* 8-*bit Color Monitor,* Proc of SPIE, V. 1666, pp 351–364, 1992, describes a display enhancement technique. It exploits the spatio-color integrative ability of the human eye in order to increase the amplitude resolution of luminance signals by splitting the luminance signal across color pixels. It is intended for visual psychophysicists studying luminance perception who need more than the usual 8-bits of greyscale resolution that are offered in affordable RGB 24-bit displays. Such studies do not require color signals, because the images displayed are grey level, and the color rendering capability of the display is thus sacrificed to create higher bit-depth grey level signals. In this case, the three color pixels contributing to the luminance signals are viewed with such a pixel size & viewing distance that the three pixels are merged into a single perceived luminance element. In other words, the pixel spacing of the three pixels causes them to be above the highest spatial frequency perceived by the visual system. This is true for luminance, as well as chromatic frequencies.

SUMMARY OF THE INVENTION

The invention is a method for increasing luminance resolution of color LCD systems, or other display systems using panels having individual pixels therein, wherein all of the pixels represent one color, at various levels of luminance. The method includes the steps of inputting an image, $I_0$, having a first resolution, wherein image $I_0$ includes color difference images, $C1_0$, $C2_0$ and a luminance image, $L_0$; manipulating images $C1_0$, $C2_0$ and $L_0$ in a first course, including: filtering and subsampling the images to form images, $C1_1$, $C2_1$ and $L_1$, having a second resolution, H×V; converting images $C1_1$, $C2_1$ and $L_1$, to a first RGB domain image, $RGB_1$; spatially multiplexing $RGB_1$ into an image $I_A$, having a third resolution, 2H×2V; and manipulating image $L_1$ in a second course, including: upsampling $L_1$ to form $L_2$, having the third resolution; forming a difference image, $I_D$ between $L_2$ and $L_0$; converting image $I_D$ into a second RGB domain image, $RGB_2$, using predetermined values for C1 and C2; subsampling $RGB_2$, spatially and chromatically, into an image $I_B$ having the third resolution; combining $I_A$ and $I_B$, in a pixel-dependant manner, into an image $I_F$; and dividing $I_F$ into RGB components at the second resolution.

An object of the invention is to display a higher spatial resolution luminance image signal than the color projection arrays (LCD panels) may support individually.

Another object of the invention is to essentially support the image's higher resolution luminance information across the interleaved color channels.

These objectives are accomplished by optical alignment specifications and image processing. The image processing steps are relatively simple, such as filtering, subsampling and multiplexing via addressing. Some optional steps have been included which depend on the color image domain, which is input to the display device.

These and other objects and advantages of the invention will become more fully apparent as the description which follows is read in conjunction with the drawings.

BRIEF DESCRIPTION OF THE DRAWINGS

FIG. 1 is a block diagram of the preferred embodiment of the method of the invention.

DETAILED DESCRIPTION OF THE PREFERRED EMBODIMENT

Figure 2:
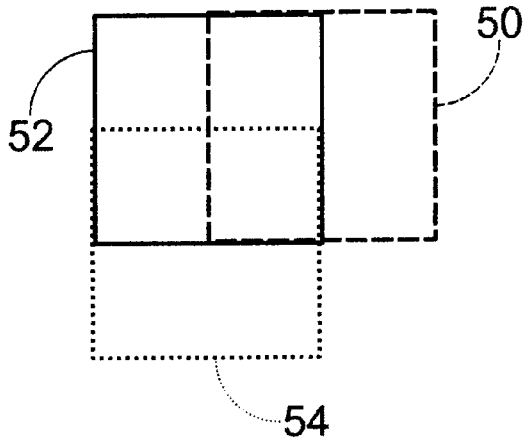
FIG. 2 depicts the panel alignment geometry in an LCD panel which uses the method of the invention.

The overall block diagram of the invention is depicted in FIG. 1, generally at 10. As previously noted, an object of the invention is to display a higher spatial resolution luminance image signal than the color projection arrays (LCD panels) may support individually. This is done by offsetting the color pixels so that a base pixel grid is created that doubles the resolution in both the horizontal and vertical directions. However, this base grid does not include all three color components so a full color image at this resolution is not possible. Fortunately, the full color image at this resolution is not needed, as only the luminance image at this resolution is required. This is because the color spatial bandwidth of the visual system is much lower than that of the luminance system.

Although the enhancement of lower resolution images, due to a lower number of samples, may lead to a perceptual illusion of increased sharpness, nothing works as well as actually increasing the amount of true information, via an increase in the number of samples. In addition to increasing perceived sharpness, increasing the number of samples will result in an overall more realistic image due to better texture rendition. Therefore, the problem to be solved is to actually display true higher spatial frequency information in a display using lower resolution imaging panels, such as LCD panels, LCD projectors, etc. However, because the chromatic bandwidth of the visual system is one-half to one-quarter that of the luminance bandwidth, it is only really necessary to increase the luminance resolution. The desired result is an image that is perceived as sharper, but one that does not contain any visible distortions, such as luminance aliasing, edge halos or ringing. The consequence of the increase in luminance resolution and a decrease in visible artifacts is to make the viewing experience more identical to direct viewing of real scenes.

Another goal of the invention is to essentially support the image's higher resolution luminance information across the interleaved color channels. The technique relies on the human visual system's low bandwidth resolution to isoluminant color patterns. The basic concept is that a high frequency color signal is integrated by the eye's retinal spectral sensitivities into a luminance-only signal of high frequency. A key element lies in the hardware of the LCD panels and system optics, where the red, green, and blue LCD pixels are spatially offset from each other by one-half pixel in both horizontal and vertical directions on the projection. Variations on this basic offset technique have been proposed as a way to minimize the visibility of the pixels, however, it has not been used in conjunction with image processing in order to display a luminance signal of higher resolution than each panel. In fact, the more common method is to align the color panels as precisely as possible so that the R, G, B pixels overlap exactly on the screen, in which case the resolution of the displayed image is exactly the same as the three individual panels.

For the purposes of this discussion, a panel display 12 includes red ($\mathbf{12}_R$), green ($\mathbf{12}_G$), and blue ($\mathbf{12}_B$) panels, each have a resolution of H×V pixels. This application addresses the case where a digital image $I_0$, or sequence, 14, is available at a higher resolution than H×V. Unless the resolution of the input image is at least twice that of the display panels, i.e., the first resolution $\geqq$2H×2V, the improvements are small, so it will be assumed the input image resolution is at least 2H×2V.

The input image, $I_0$, is manipulated in two separate courses in the preferred embodiment depicted in FIG. 1. Input image 14 is assumed to be in a luminance and color difference domain, such as Y, R-Y, and B-Y, where Y is the luminance signal and R-Y and B-Y are the color difference signals. Other color difference domains include CIELAB, YUV, YIQ, etc. If, however, the image is input as an RGB domain signal, it is necessary to convert the image to a color difference domain via color transform 16. Color transform 16 may be skipped if input image 14 is in a luminance and color difference domain. At this point, regardless of the exact color domain of the input, there are two color difference images: C1, 18 and C2, 20 and one luminance image L, 22 at the input resolution.

These high resolution images are each subsampled down to the H×V resolutions, the second resolution, of the display panels in steps 24 ($C1_1$), 26 ($C2_1$), and 28 ($L_1$). Various types of filters may be used here, with cubic spline generally performing the best and nearest neighbor averaging being the easiest to implement. It is also possible to simply subsample directly, without using any filtering, at the expense of aliasing. The images $C1_1$, $C2_1$ and $L_1$, are now converted to the RGB domain 30 via an inverse color transform to an image $RGB_1$. In the known prior art, these three images would have been loaded into the R, G, and B display panel buffers 12, and consequently displayed.

$RGB_1$ is expanded from size H×V to 2H×2V, the third resolution, in step 32, resulting in an image $I_A$. This also uses a position dependent addressing where each of the 2H×2V pixels only contain one R, G, or B value. This step is referred to as spatio-chromatic upsample multiplexing and the color locations match that resulting from the other multiplexing step 44, to be described in more detail later herein. In this embodiment of the multiplexing, however, no pixels are omitted, as occurs in another embodiment of the invention, as there are actually more pixel positions in the 2H×2V array than are available from the total of the three H×V arrays of color planes. This step will be described in more detail later herein.

The key to improving resolution is to utilize the high resolution luminance image, $L_0$, 22. If image $L_0$ has a resolution greater than 2H×2V, the first step 34, in the second course, is to reduce its resolution to 2H×2V, forming $L_1'$. The preferred method of resolution reduction is to filter then subsample. The lower resolution version of this luminance image $L_1$, generated at step 28, is upsampled to 2H×2V, step 36, to form $L_2$. $L_2$ is, in the preferred embodiment, formed by interpolation, although other techniques may be used.

A difference image, $I_D$, is formed, step 37, between the upsampled image, $L_2$ and the high resolution luminance image, $L_0$ or $L_0'$, at resolution 2H×2V. This difference image is the high-pass content of the high resolution luminance image from step 22. Image $I_D$ is then converted, step 38, to the RGB color domain, $RGB_2$, via the same inverse transform as was used in step 30, but in this case, there is no color difference image components. As shown in block 38, C1 and C2 are indicated as having constant values for all pixels. Depending on the color transform, these values may be 0, or 128, or any value that indicates the absence of color content.

Next, step 40 may be performed to inverse weight $RGB_1$ signals so they have a contribution equal to luminance. These values will depend on the exact spectral emissions from optical system housing the LCD panels, and are input by the system designer, block 42. Generally, red and blue will be boosted relative to green, because in video displays, perceived luminance Y=0.32*R+0.57*G+0.11*B, and a goal of the invention is to compensate for this visual phenomenon.

The output, $RGB_2$, is then subsampled both spatially and chromatically, block 44, in a position-dependent technique, such that only one of the R, G or B layers fills any pixel. Consequently, the output is an image $I_B$ of 2H×2V that does not have a full color resolution of 2H×2V. Only a portion of the available pixels are used, while the others are deleted, since the three R, G, and B planes of 2H×2V must be reduced to one plane of 2H×2V. This step will be described in more detail later, and is referred to as spatio-chromatic downsample multiplexing.

The two resulting multiplexed images from 32 and 44, $I_A$ and $I_B$, respectively, at resolution 2H×2V, are then added in a pixel position dependent manner, block 46, to form an image $I_F$. The colors of this image are aligned so that only red pixels are added to red pixels, green to green, etc. The consequence and goal of this step is to add the high resolution luminance information, albeit carried by high frequency color signals, to the full color image at the lower resolution of the display panels. This image is then converted back to three separate R, G, B planes via a demultiplexing step 48, that will also be explained in more detail later herein. The result is three H×V image planes $12_R$, $12_G$ and $12_B$, which are sent to the image buffer of display panel 12 for projection via the system optics.

Referring now to FIG. 2, the display panel alignment geometry will be described. In FIG. 2, an overlapped pixel includes a red pixel component 50, a green pixel component 52, and a blue pixel component 54. The alignment of these three color pixels for a single pixel position of the panel image buffers is shown. Essentially, the red pixel is shifted horizontally to the right of green, and the blue pixel is shifted ½ pixel down. The order of the R, G, B locations is not important, as long as the three pixels are shifted by ½ pixel with respect to each other.

Figure 3:
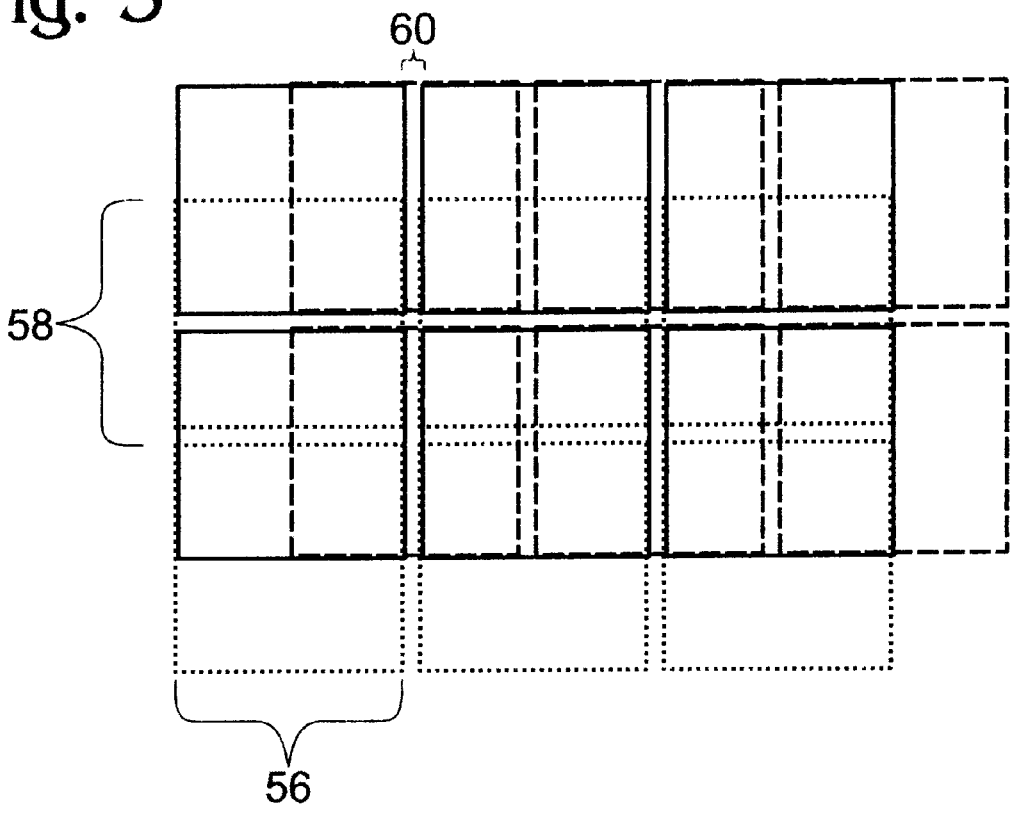
FIG. 3 is a block diagram of a portion of a displayed image.

The geometric effect of displaying the three image panels in this manner is shown for a portion of the displayed image in FIG. 3. The spacing between the centers of pixels, having a pixel width 56, within any color plane is referred to as the pitch 58. Due to manufacturing constraints, the pixels within a color plane cannot be contiguous, so there is a gap 60 between each adjacent pixel in a plane. The gap is somewhat narrowed by optical spread in the lens system. With this overlapped pixel geometry, all areas on the screen receive light. The gaps between neighboring pixels for any color plane are covered with light from the other two planes. Thus, the visibility of a grid due to the gaps between pixels is minimized. The repetition of this pixel geometry results in three grids of H×V resolution, each grid being offset from the other two grids by ½ pixel widths.

Figures 4, 5:
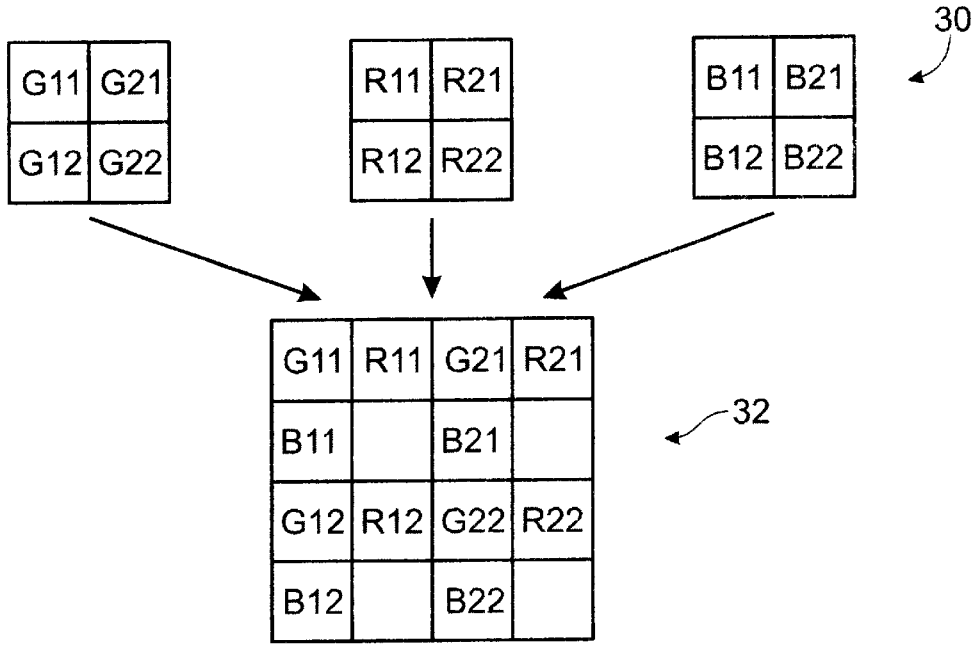
FIG. 4 depicts a combination of three color planes used to generate an image.
FIG. 5 is a block diagram of a spatio-chromatic upsample multiplexing of the invention.

Considering the locations of the centers of these grids, the three color planes may be represented as a single plane, as shown in FIG. 4, which now contains all three primary colors, but at most contains only one color at any given location. The resolution of this representation is 2H×2V, where the horizontal increase in resolution is due to the interleaving of the red and green pixels, and the vertical increase is due to the interleaving of the green and blue. Even though the individual planes only have H×V elements, the spatial offset causes the number of available edges in both H and V directions to be doubled. Of course, the edges do not have the full color gamut available, but they do provide the opportunity to convey changes in the image, in other words, information content. The idea is that the color content of the edges are not perceived due to their resolution as displayed on the screen in conjunction with the expected viewing distance. Rather, only the luminance component of these edges are perceived. It is this luminance component that will contribute to the perceived increase in sharpness and image detail.

Note that there is a missing pixel in this 2H×2V grid, which conceivably could be filled with one of the colors.

However, this would take an extra color plane, and the cost increase would not justify the image quality increase. If we make the simplifying assumption that the luminance component is entirely conveyed with the green pixels, we may see that adding this missing pixel will not increase horizontal or vertical resolution. Rather, it will only increase the diagonal resolution, and it is known that the diagonal resolution of the visual system is reduced by about 70% of that of the horizontal and vertical.

FIG. 5 shows the spatio-chromatic upsample multiplexing step 32 of FIG. 1 in more detail. Its inputs are the $RGB_1$ images output from the inverse color transform 30, which are normally input to the display panel buffers 12. In this upsample multiplexing step, the pixels from each color plane are loaded into the spatio-chromatic multiplex domain image $I_A$ as indicated by the subscripts. The three layers are reduced to one layer, but the resolution is increased from H×V to 2H×2V. Note in this step that all the pixels from the H×V images are used.

Figure 6:
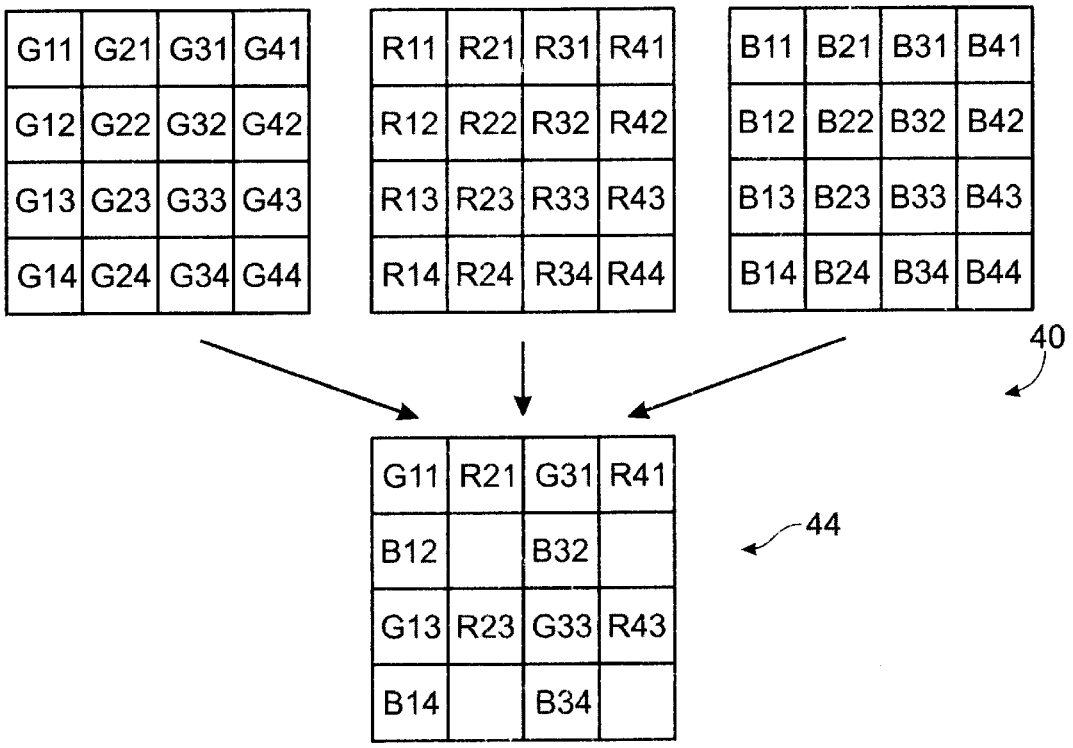
FIG. 6 is a block diagram of a spatio-chromatic downsample multiplexing of the invention.

FIG. 6 shows the spatio-chromatic downsample multiplexing, step 44 of FIG. 1. The $RGB_1$ images output from step 38, or from step 40 if it is incorporated into the method of the invention, is available as RGB planes each of resolution 2H×2V. The image is reduced to a single 2H×2V resolution image, $I_B$, which is referred to as the spatio-chromatic multiplex domain by spatio-chromatic multiplexing, that is, selectively sampling each color plane based on position. In this step, only one-quarter of the pixels of each color plane are retained; the rest are omitted. Filtering may be used in this step, although filtering is not used in the preferred embodiment. The subscripts indicate the (x, y) pixel positions at the 2H×2V resolution and depict how the single layer image $I_B$ is filled. Note that in this image the resolution of each color plane is only one-half that of its input at step 40, i.e., each is now reduced from 2H×2V to H×V.

As previously noted, at this stage, image $I_B$ is added to the spatio-chromatic upsample multiplexed image, $I_A$, generated from step 32, which is derived from the $RGB_1$ images at the display panel resolution. The addition is pixel-wise and R pixels are added to R pixels, etc. The output of this addition step is then demultiplexed 48 (FIG. 1) back to three separate color planes, $\mathbf{12}_R$, $\mathbf{12}_G$ and $\mathbf{12}_B$, each having resolution H×V. Note that in this step, all the pixels are utilized.

Because these three color panel display images are offset to each other as indicated in FIGS. 2 and 3, and the image processing step of reducing from an 2H×2V image has taken the offset into account, the net effect is that the final displayed image has a luminance resolution of 2H in the horizontal direction, 2V in the vertical direction. It does not however, have this resolution for the full color gamut of the image, nor does it have this resolution for diagonal frequencies. Fortunately, these resolution losses are matched to the weaknesses of the visual system.

The chromatic bandwidth of the visual system is less than ½ that of the luminance bandwidth. These bandwidths are specified in spatial frequencies of the visual space, in units of cycles/visual degree. These frequencies may be mapped to the digital frequencies represented by pixels of the images, by taking into account the physical pixel size as displayed and the viewing distance. Since these two values scale equally, a doubling of the physical dimension of the pixels and a doubling of the viewing distance will result in an identical perception. Therefore, to take into account the fact that a projection system allows a variable image size, the viewing distance is specified in multiples of image dimensions, and picture height is usually used. Specifying the viewing the distance in multiples of pixels height is also valid, although it leads to large numbers.

A system utilizing this invention has the following behavior: For very far viewing distances, the advantage due to the multiplexing is minimal. As the viewing distance shortens, the extra luminance bandwidth of the invention leads to a perceived sharpness and image detail. This is, in fact, more than merely perceived. The image physically has higher frequencies of true information. As the viewing distance decreases further, the offset color signals used to carry the luminance information becomes visible in the form of chromatic aliasing, with the perception of fine colored specks and stripes through the image. In this condition, the region of chromatic aliasing falls to lower frequencies than the visual chromatic bandwidth limit, thus allowing their visibility. Another consequence is that the individual triad elements of the RGB pixels begin to be detected by the chromatic visual system. At the proper viewing distance, however, the chromatic visual system cannot distinguish the individual elements, although the luminance visual system can. The resulting range of the effective viewing distance is a design parameter that is a function of the resolution of the display panels.

There are three alternate embodiments of the method of the invention that will now be described. Two of these are simplified in complexity, and have an associated reduction in performance. The other provides an enhanced image quality to that of the preferred embodiment. However, it is more complex and has higher costs, in terms of equipment and processing time.

Figure 7:
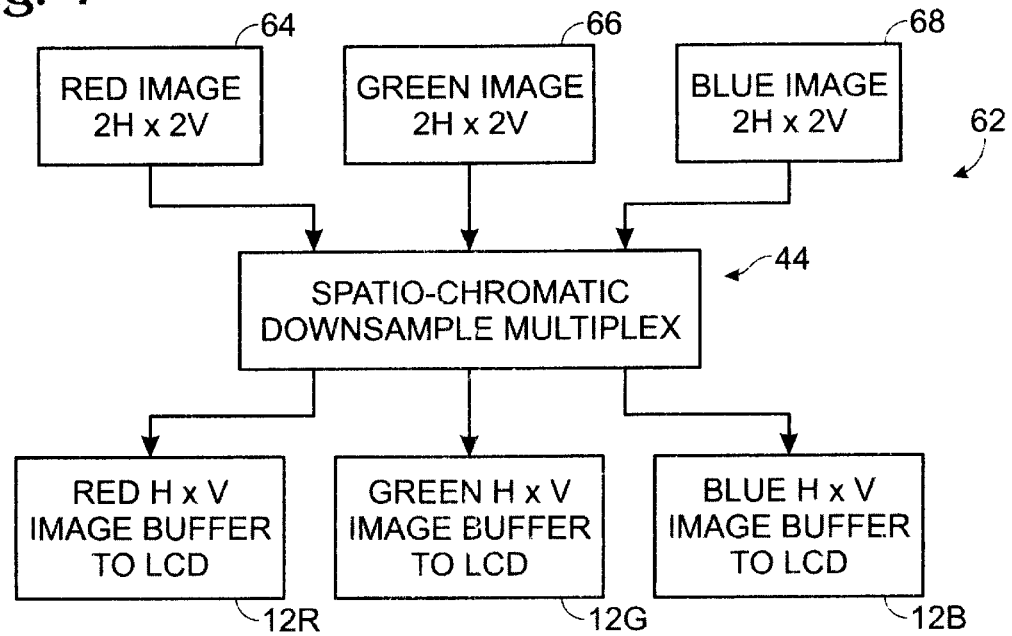
FIG. 7 is a block diagram of a second embodiment of the method of the invention.

FIG. 7 depicts the simplest embodiment of this invention, generally at 62, which has the reduction in performance as high frequency chromatic patterns will alias down to lower chromatic and luminance frequencies. It consists of basically multiplexing the R (64) G (66) B (68) high resolution (2H×2V) image $I_0$, 64, 66, 68 directly to the spatio-chromatic multiplex domain 44. The multiplexing/demultiplexing steps are as shown in FIG. 6, with the result being three color plane images 12 of resolution H×V. The embodiment may be further simplified to a single step method by loading the high resolution 2H×2V color planes into a display panel image buffers that will read an image of only H×V resolution.

Figure 8:
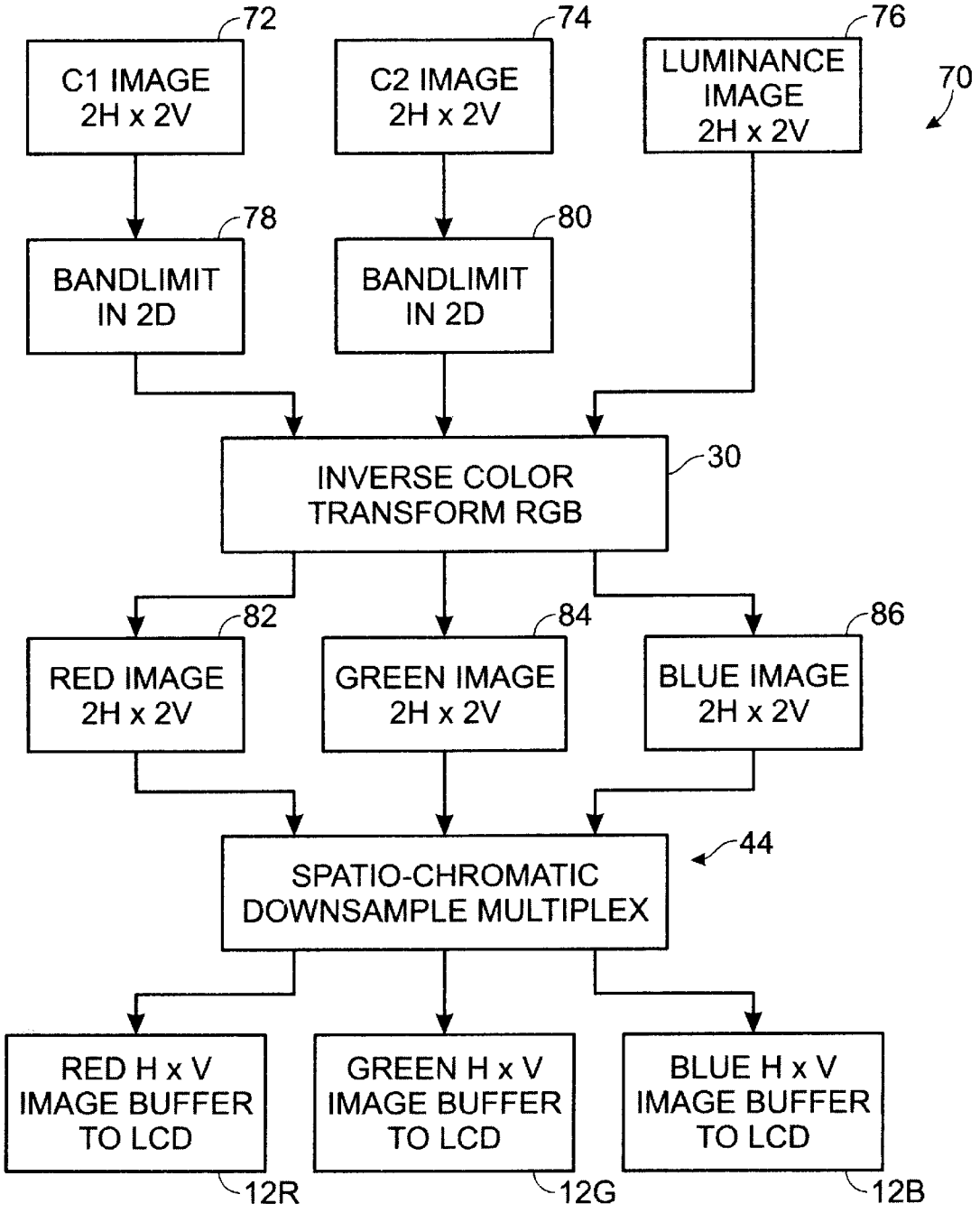
FIG. 8 is a block diagram of a third embodiment of the method of the invention.

FIG. 8 depicts a block diagram 70 of an embodiment that lies between that of FIG. 1 and FIG. 7 in both performance in image quality, as well as in complexity. It begins with an image $I_0$ in a color difference and luminance domain, $Cl_0$ (72), $C2_0$ (74), and $L_0$ (76), and includes steps 78, 80 of limiting the chromatic bandwidth while in the color transform space having a luminance and color difference images. Only the color difference images are bandlimited. They are bandlimited by low-pass filtering in both the horizontal and vertical directions. An isotropic filter is preferred here. These band-limited images are inverse color transformed, 30, to the R (82), G (84), and B (86) domain and downsample multiplexed 44, similarly to the step depicted in FIG. 7, resulting in image components $\mathbf{12}_R$, $\mathbf{12}_G$, and $\mathbf{12}_B$.

Figure 9:
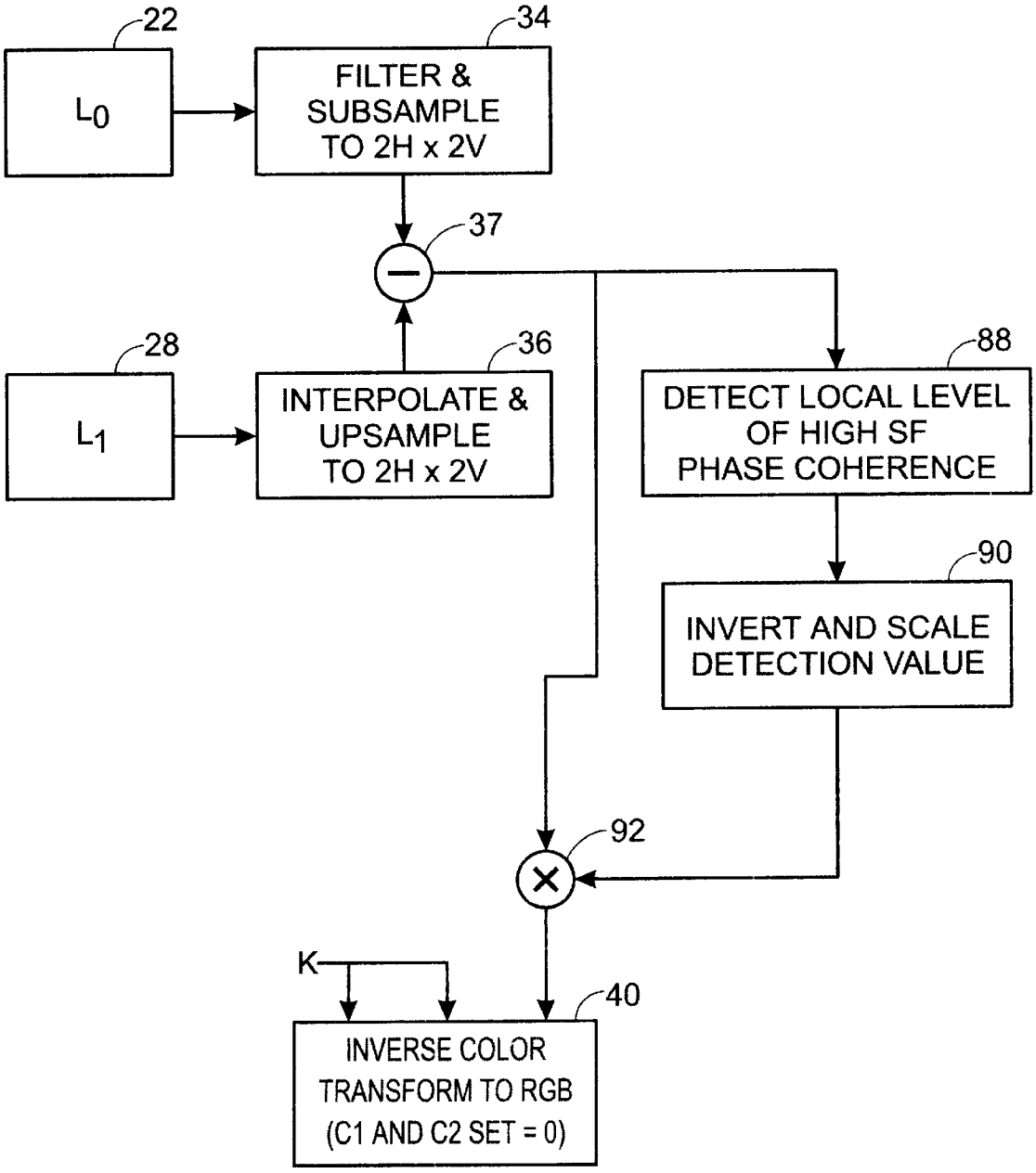
FIG. 9 is a block diagram of a fourth embodiment of the method of the invention.

FIG. 9 depicts another embodiment that has higher complexity than that shown in FIG. 1, but which delivers a higher image quality. In particular, the areas where the eye is most sensitive to the luminance signal being aliased into color is for high frequency regions with coherent phase and having limited orientation. An example of regions like this are stripes and lines. This method detects a localized high frequency phase coherence, step 88, prior to step 38 (FIG.

1). This detection step may be implemented as simple pattern detection, for example. If the region is detected as consisting of either stripes or lines, in either a fixed threshold, or graded detection result, the amplitude of the high-pass component is reduced in proportion to the degree to which it consists of the subject patterns. The scaled inverse 90 of the result of the detection are determined. The scaled inverse is multiplied, in step 92, by the high-pass luminance component, $L_2$. Standard methods of pattern detection for lines and stripes may be used, including small local FFTs, DCTs, or other spatial-based techniques. Or another form of correction is to add noise in proportion to the degree to which the elements are detected as stripes and lines.

Although a preferred embodiment of the invention, and variations thereof, have been disclosed, it should be appreciated that further variations and modification made be made thereto without departing from the scope of the inventions as defined in the appended claims.

I claim:

1. A method for increasing luminance resolution of color panel systems, comprising:

(a) inputting an image, $I_0$, having a first resolution, wherein image $I_0$ includes color difference images, $C1_0$, $C2_0$ and a luminance image, $L_0$;

(b) manipulating images $C1_0$, $C2_0$ and $L_0$ in a first course, including:

(i) filtering and subsampling the images to form images, $C1_1$, $C2_1$ and $L_1$, having a second resolution, H×V;

(ii) converting images $C1_1$, $C2_1$ and $L_1$, to a first RGB domain image, $RGB_1$;

(iii) spatially multiplexing $RGB_1$ into an image $I_A$, having a third resolution, 2H×2V;

(c) manipulating image $L_1$ in a second course, including:

(i) upsampling $L_1$ to form $L_2$, having the third resolution;

(ii) forming a difference image, $I_D$ between $L_2$ and $L_0$;

(iii) converting image $I_D$ into a second RGB domain image, $RGB_2$, using predetermined values for C1 and C2;

(iv) subsampling $RGB_2$, spatially and chromatically, into an image $I_B$ having the third resolution;

(d) combining $I_A$ and $I_B$, in a pixel-dependant manner, into an image $I_F$; and (e) dividing $I_F$ into RGB components at the second resolution.

2. The method of claim 1 wherein the first resolution is XH×YV, where X, Y≧2.

3. The method of claim 2 wherein said inputting includes inputting an image having a resolution of XH×YV, where X, Y>2, and wherein said manipulating the image in the second course includes filtering and subsampling the image to reduce the resolution to 2H×2V.

4. The method of claim 1 wherein said inputting includes inputting an image in an RGB domain, and transforming the RGB domain image into color difference domain images, $C1_0$, $C2_0$ and a luminance image, $L_0$.

5. The method of claim 1 which includes, after said converting image $I_D$, inversely weighting the RGB signals to provide equal contributions to the L signal values.

6. The method of claim 1 wherein said subsampling $RGB_2$ includes:

(i) reducing the RGB planes of $RGB_2$ to a single image of the third resolution, and (ii) selectively sampling each RGB plane based on pixel position using one-quarter of the pixels in each plane and discarding any unused pixel.

7. The method of claim 1 wherein said spatially multiplexing $RGB_1$ into an image $I_A$ includes reducing the RGB planes of $RGB_1$ into a single image of the third resolution.

8. The method of claim 1 which further includes detecting a localized high-frequency phase coherence in $I_D$, determining a scaled inverse of the localized high-frequency phase coherence in $I_D$, and multiplying the scaled inverse of the localized high-frequency phase coherence in $I_D$ by $L_2$.

9. A method for increasing luminance resolution of color panel systems, comprising:

(a) inputting an image, $I_0$, having a first resolution, wherein image $L_0$ includes color difference images, $C1_0$, $C2_0$ and a luminance image, $L_0$;

(b) bandlimiting images $C1_0$, $C2_0$ to form images $C1_1$, $C2_1$;

(c) converting images $C1_1$, $C2_1$ and $L_0$, to a first RGB domain image, $RGB_1$;

(d) spatially multiplexing $RGB_1$ into an image $I_A$, having a third resolution, 2H×2V;

(e) subsampling $I_A$, spatially and chromatically, into an image $I_B$ having the third resolution; and (f) dividing $I_B$ into RGB components at a second resolution, H×V.

10. The method of claim 9 wherein said inputting includes inputting an image having a resolution of XH×YV, where X, Y>2, and which includes manipulating the image in image to reduce the resolution to 2H×2V.

11. The method of claim 9 wherein said inputting includes inputting an image in an RGB domain, and transforming the RGB domain image into color difference domain images, $C1_0$, $C2_0$ and a luminance image, $L_0$.

12. The method of claim 9 wherein said subsampling $I_A$ includes:

(i) reducing the RGB planes of $I_A$ to a single image of the third resolution, and (ii) selectively sampling each RGB plane based on pixel position using one-quarter of the pixels in each plane and discarding any unused pixel.

13. A method for increasing luminance resolution of color panel systems, comprising:

(a) inputting an image, $RGB_1$, having RGB color planes, at a first resolution;

(b) subsampling $RGB_1$, spatially and chromatically, into an image having a second resolution, including (i) reducing the RGB color planes of $RGB_1$ to a single image of a third resolution, and (ii) selectively sampling each RGB plane based on pixel position using a sub-set of the pixels in each plane and discarding any unused pixel; and (c) dividing the image having the second resolution into RGB components at a second resolution.

14. The method of claim 13 wherein the first resolution is XH×YV, where X, Y≧2.

15. The method of claim 13 wherein said inputting includes inputting an image having a resolution of XH×YV, where X, Y>2, and which includes manipulating the image to reduce the resolution to 2H×2V.

16. The method of claim 13 wherein said inputting includes inputting an image in a color difference domain images, $C1_0$, $C2_0$ and a luminance image, $L_0$, and transforming the color difference domain image into an RGB domain image.

* * * * *